US009027246B2

(12) United States Patent
Linow

(10) Patent No.: US 9,027,246 B2
(45) Date of Patent: May 12, 2015

(54) METHOD FOR PRODUCING A CARBON BAND FOR A CARBON INFRARED HEATER, METHOD FOR PRODUCING A CARBON INFRARED HEATER, AND CARBON INFRARED HEATER

(75) Inventor: Sven Linow, Darmstadt (DE)

(73) Assignee: Heraeus Noblelight GmbH, Hanau (DE)

( * ) Notice: Subject to any disclaimer, the term of this patent is extended or adjusted under 35 U.S.C. 154(b) by 826 days.

(21) Appl. No.: 13/259,266

(22) PCT Filed: Feb. 10, 2010

(86) PCT No.: PCT/EP2010/000805

§ 371 (c)(1),
(2), (4) Date: Sep. 23, 2011

(87) PCT Pub. No.: WO2010/108571

PCT Pub. Date: Sep. 30, 2010

(65) Prior Publication Data

US 2012/0018423 A1 Jan. 26, 2012

(30) Foreign Application Priority Data

Mar. 23, 2009 (DE) ..... 10 2009 014 079

(51) Int. Cl.

| | |
|---|---|
| ***H05B 3/10*** | (2006.01) |
| ***H05B 3/56*** | (2006.01) |
| ***H05B 3/14*** | (2006.01) |
| ***H05B 3/44*** | (2006.01) |

(52) U.S. Cl.

CPC ..... *H05B 3/56* (2013.01); *H05B 3/145* (2013.01); *H05B 3/44* (2013.01); *H05B 3/565* (2013.01); *H05B 2203/032* (2013.01)

(58) Field of Classification Search

CPC ..... H01K 3/02; H05B 3/145; H05B 3/14; H05B 3/44; H05B 3/42; H05B 2203/032

USPC ..... 29/419.1, 890.03

See application file for complete search history.

(56) References Cited

U.S. PATENT DOCUMENTS

| | | | |
|---|---|---|---|
| 4,960,979 | A | 10/1990 | Nishimura |
| 6,464,918 | B1 | 10/2002 | Scherzer et al. |

(Continued)

FOREIGN PATENT DOCUMENTS

| | | | |
|---|---|---|---|
| DE | 19839457 | A1 | 3/2000 |
| EP | 0881858 | B1 | 5/2004 |

(Continued)

OTHER PUBLICATIONS

Int'l Search Report issued Jun. 9, 2010 in Int'l Application No. PCT/EP2010/000805; Written Opinion.

*Primary Examiner* — David Bryant
*Assistant Examiner* — Jason L Vaughan
(74) *Attorney, Agent, or Firm* — Panitch Schwarze Belisario & Nadel LLP

(57) ABSTRACT

A method is provided for reproducibly producing a carbon band twisted about its longitudinal axis. According to the method carbon fibers are fed into a processing device and are formed into a band-shaped preform having a centerline and an edge on both sides thereof. A shorter average fiber length is fed by the processing device when forming the centerline area than when forming the edges. The preform is subsequently further processed into the carbon band.

16 Claims, 1 Drawing Sheet

(56) References Cited

U.S. PATENT DOCUMENTS

| | | | | |
|---|---|---|---|---|
| 7,705,526 | B2 * | 4/2010 | Lee et al. | 313/273 |
| 7,769,278 | B2 * | 8/2010 | Kim et al. | 392/407 |
| 2004/0211772 | A1 | 10/2004 | Park | |
| 2006/0016803 | A1 * | 1/2006 | Kim et al. | 219/553 |

FOREIGN PATENT DOCUMENTS

| | | | |
|---|---|---|---|
| EP | 1619931 | A1 | 1/2006 |
| EP | 1693882 | A1 * | 8/2006 |
| GB | 2278722 | A | 12/1994 |

* cited by examiner

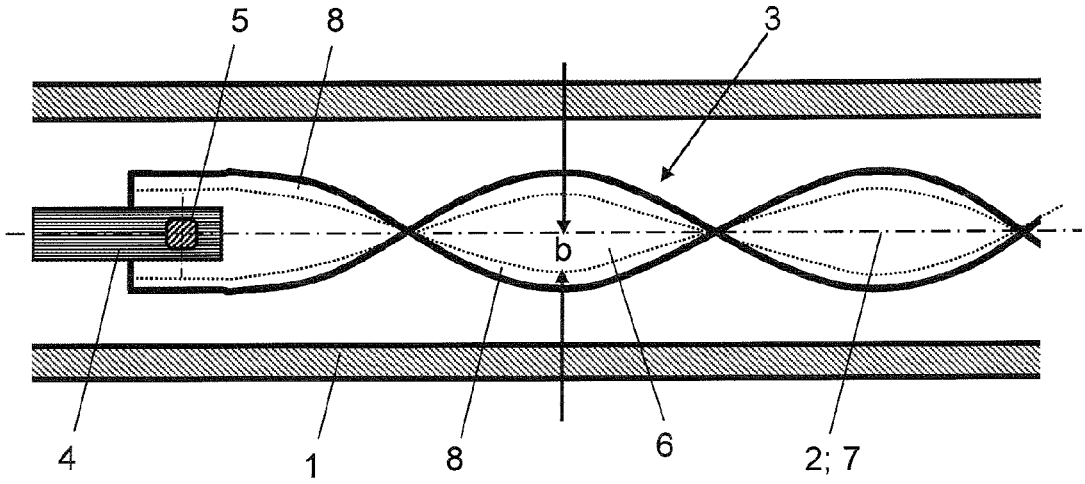
5
8
3
b
4
1
8
6
2; 7

METHOD FOR PRODUCING A CARBON BAND FOR A CARBON INFRARED HEATER, METHOD FOR PRODUCING A CARBON INFRARED HEATER, AND CARBON INFRARED HEATER

CROSS-REFERENCE TO RELATED APPLICATIONS

This application is a Section 371 of International Application No. PCT/EP2010/000805, filed Feb. 10, 2010, which was published in the German language on Sep. 30, 2010, under International Publication No. WO 2010/108571 A1 and the disclosure of which is incorporated herein by reference.

BACKGROUND OF THE INVENTION

The invention relates to a method for producing a carbon band twisted about a longitudinal axis for a carbon infrared heater.

Furthermore, the invention relates to a method for producing a carbon infrared heater, comprising the preparation of an envelope tube made of quartz glass, into which is inserted a carbon band twisted about its longitudinal axis, and whose ends are provided with electrical terminals, which are led out from the envelope tube.

In addition, the invention involves a carbon infrared emitter having an envelope tube made of quartz glass, in which is arranged a carbon band containing carbon fibers, which is twisted about its longitudinal axis and whose ends are provided with electrical terminals, which are led out from the envelope tube.

Infrared emitters having a heating element made of carbon fibers distinguish themselves by a high reaction rate and thus allow particularly quick temperature changes. From German published patent application DE 198 39 457 A1 a method is known for producing a carbon band wound in a spiral shape for an infrared emitter. To this end, a band-shaped starting material is used, in which carbon fibers are embedded in a thermoplastic embedding compound. After heating the starting material to the softening temperature, the embedding compound softens, so that the band-shaped material can be wound in a spiral shape onto a mandrel. Through carbonization the embedding compound is converted into a carbon and in this way the spiral-shaped carbon band is fixed in its shape, so that later plastic deformation is prevented in its proper use as a heating element in an infrared emitter.

The known method allows the production of spiral-shaped heating elements from a carbon band. Due to the spiral shape the surface of the resulting heating element is significantly larger than the surface of a cylindrical, elongated heating element of equal length and thus generates a higher radiation power output (at the same temperature).

In European patent application publication EP 1 619 931 A1 an infrared emitter is described in which the heating element is present in the form of a twisted carbon filament. With respect to the production of the twisted filament, it is disclosed that it is generated by pressing a plurality of carbon films, which are layered one above the other and are connected rigidly to each other. It is furthermore to be inferred that, for producing the electrical terminals at the two ends of the filament, thin metal networks are provided that would be embedded between layers of the carbon films during the pressing process. A secure connection should allegedly result between the electrical terminals and the carbon filament.

It is not explained how a solid body in the form of an elongated band or a mechanical joint connection between carbon films and a metal network should be able to be produced through simple pressing of layers made of carbon films. In addition, there is the risk that the embedded metal network experiences carbonization, due to heating during the operation of the emitter, through the contact with the carbon from the carbon filament. This carbonization can lead to changes in the crystal lattice and to carbide formation in the metal, so that hardness, strength, and coefficient of thermal expansion change and, in particular, the electrical conductivity becomes worse. This worsening of the electrical conductivity generates additional heating during operation and thus an accelerated conversion into carbide.

A suitable way of contacting carbon bands for heating emitters is known from European Patent EP 0 881 858 B1. Therein, the production of carbon infrared heaters having filaments from elongated bands is described, which is obtained by heating processes from unidirectional, fiber-reinforced thermoplastic. For contacting, bonded thick sections are provided on the band ends, which are fixed and held by springs made of molybdenum sheeting.

BRIEF SUMMARY OF THE INVENTION

The invention is based on the object of providing a carbon infrared heater having a carbon band twisted about its longitudinal axis, which distinguishes itself by constancy of the emission properties and by long service life.

In addition, the invention is based on the object of specifying a method for the production of such a carbon infrared heater, as well as a method for the reproducible production of a twisted carbon band.

With respect to the method for the production of the carbon band, this object is achieved starting from a method of the type cited above, in that carbon fibers are fed to a fiber-processing device and are formed into a band-shaped perform, which has a centerline and an edge on both sides of this centerline, wherein for the shaping of the region close to the centerline, a fiber length is fed by the fiber-processing device, which is smaller on average than the fiber length for the shaping of the regions close to the edge, and the preform is then further processed into the carbon band.

When a band is twisted, the geometrical condition is to be taken into account, according to which a twisted structure—comparable to a screw line—has a greater length at the edge than at the center. A flat carbon band—as a component made of a brittle-elastic material that allows practically no plastic deformation—cannot be twisted at all or at least not without introducing high elastic stresses due to this geometrical condition.

The method known from DE 198 39 457 A1 allows the plastic deformation of a material containing carbon fibers. Based on this procedure, a flat band-shaped starting material, in which carbon fibers are embedded in a matrix made of thermoplastic material, can thus be deformed plastically by softening the matrix and thus be brought into a twisted band structure. Due to the geometrical conditions mentioned above, however, an elongation of the edge regions of the band and a reduction of the band thickness from the band center to the edge thereby occurs. This can lead to rejects or to a reduction of the band thickness from the center toward the edge or even to tears starting from the edge.

In order to avoid these disadvantages, according to the invention, a preform is first generated from fibers, which either already has the twisted structure or which has set in it at least enough twisting that later twisting can be achieved without greater mechanical loading. This property is also designated below as "pre-twisting."

For the production of this pre-twisted preform, a fiber-processing device is used that is suitable for processing fibers into a band, similar to machines for the production of textile materials. Carbon fibers or carbon fibers together with a binding agent are fed to the fiber-processing device. In the latter case, the carbon fibers are encased partially or completely by the binding agent, and thus the carbon fibers or bundles of carbon fibers are connected to each other by the binding agent. By the fiber-processing device, however, no flat or smooth band is produced, but instead a non-flat band in the form of the pre-twisted preform. This takes place in that, for the production of the band in the region of the side edges, more fiber material is fed than for the production of the central region around the centerline of the band. In this way, the band-like preform obtains in advance a pre-twisted structure or—when the band is stretched—a structure that buckles into folds or undulations at both edges.

For the preform obtained in this way, a subsequent mechanical twisting is either no longer needed or it is already set in the preform by the spatial distribution of the carbon fibers, such that it can be carried out without greater mechanical loads on the preform.

The method according to the invention also allows a uniform mass distribution of carbon fibers across the surface area of the twisted band. This property can be noticed in a heating element produced from such a preform for a carbon infrared heater in the form of good spatial homogeneity of the emission, and it effects a lengthening of the service life of the heating element.

The further processing of the preform comprises, for example, a carbonization step for converting the binding agent into carbon and—if still required—a processing step before the carbonization for the production of the final twisting from the pre-twisted preform.

Here it has proven especially effective if the fiber length fed by the fiber-processing device during formation gradually increases on average from the region close to the centerline toward the regions close to the edges.

The desired "pre-twisting" is already produced when a larger fiber length on average is provided only at the outer edge of the band-shaped preform than in the middle. A one-step change in fiber density, however, can lead to a certain tension within the carbon band and to undesired warping. Therefore, in the preferred method variant, it is provided that the average fiber length increases gradually from the center toward the edge. This is understood to be a continuous increase or a step-by-step increase (in several small steps) of the fiber length.

In order to obtain an especially stable, tension-free band shape having no warping, the fiber lengths supplied for the band production during the fiber processing should be controlled and varied in the smallest possible steps across the width of the band.

In an especially preferred procedure according to the invention it is provided that the fiber length "a" fed by the fiber-processing device is set as a function of the distance "b" from the centerline and the number of pre-twists "u" over the length "l" of the centerline according to the following formula:

$$a=\sqrt{l^2+(2\cdot\pi\cdot b\cdot u)^2} \quad (1)$$

Equation (1) describes the length a of a line along a screw shape as a function of the distance b of the line from the centerline of the screw and the number of screw windings u across over the length l, wherein the centerline coincides with the screw longitudinal axis. One complete screw winding here describes a full circle of 360° about the centerline. The equation can be viewed as a directive for the distribution of the carbon fiber length as a function of the distance from the centerline of the band-shaped preform. The shortest fiber length (l) lies in the centerline. The difference (a−l) describes the difference of the fiber lengths at the distance (b) for the shortest fiber length. Preferably, the production tolerances of the desired value obtained according to equation (1) of the length (a−l) lie in the range ±10% or alternatively up to approximately 1/100*1 (according to which of the two alternative calculation methods produces the greater value); in an especially preferred way, the deviations from the desired value of the length (a−l) lie in the range ±2% or up to approximately 1/1000*1 (according to which of the two calculation methods produces the greater value).

According to the number (u) of pre-twists (corresponding to the screw windings of a screw) and the length l of the preform, considerable differences of the fiber lengths (a−l) are produced between the center and edge of the band-shaped preform. The greater the number (u) of pre-twists is per unit of length, the more homogeneous the radiation distribution is. On the other hand, for large differences in length (a−l), a greater difference is also set in the electrical resistance, which has an unfavorable effect on the homogeneity of the radiation distribution.

If the fiber length fed at the edge exceeds 25%, then due to the associated reduction of the electrical resistance in the outer region, the power released there is noticeably reduced. This effect can be used for emitters having a very high filament temperature close to the centerline. Through a gradient in the temperature of the pre-twisted band generated in this way, the regions of the band touching the glass tube are kept cool, so that devitrification is prevented there, while significantly increased temperatures exist in the central region of the band.

Consequently, in one preferred embodiment of the method according to the invention it is provided that the fiber length fed on average for the formation of the region close to the centerline and the fiber length fed on average for the formation of the regions close to the edges differ by between 4% and a maximum of 15% (with respect to the shortest fiber length (l)).

It has further proven advantageous if the band-shaped preform is generated as a textile fiber composite, in particular woven, braided, knitted, or knotted, wherein a weaving, braiding, knitting, or knotting machine is used as the fiber-processing device.

With web-like textile structures, a fiber composite is generated that contributes to the mechanical stabilization of the preform and the carbon band produced from this preform. With woven bands, the desired twisting can be generated relatively easily in that warp or chaining threads are fed across the width of the band in correspondingly stepped lengths for the production of the band.

With a braided, knitted, or knotted fiber composite, this is preferably stabilized by warp or chaining threads, wherein the length of the warp or chaining threads is varied as a function of their distance from the centerline.

With braided, knitted, or knotted bands, an additional stabilization of the twisting is produced by the use of the warp or chaining threads with correspondingly stepped length, preferably a length that is determined with reference to the above equation (1). An additional stabilization of the carbon fibers with a binding agent is advantageous.

A procedure in which the carbon fibers are fed to the fiber-processing device in the form of rovings, each of which contains less than 6000 fibers, preferably less than 1000 fibers, in straight alignment, has proven especially effective.

The so-called "rovings" contain a plurality of fibers in non-twisted form. With respect to a lowest possible thickness of the carbon band, it has proven favorable when rovings having a small number of fibers are used. This allows also a more uniform distribution of the carbon fiber mass within the pre-twisted preform. Rovings having fewer than 500 fibers generate a relatively large effort and are therefore not preferred.

In one especially preferred embodiment of the method according to the invention, it is provided that, when forming the band-shaped preform, carbon fibers and a thermoplastic material are used as the binding agent, and that the preform is constructed as a twisted band or as a non-twisted, crimped band, which has alternating folds above and below the centerline along the longitudinal axis, and that the further processing to form the carbon band comprises a twisting of the preform.

In this procedure either an already twisted preform is generated directly by the fiber-processing device or a band-shaped preform that exists as an elongated, but not flat, band is generated. This preform has, at the edge, due to the locally accumulated larger fiber length, folds or undulations that form alternately above and below the centerline, and specify a subsequent twisting about the longitudinal axis and, in this respect, likewise represent a pre-twisting. With the use of a thermoplastic binding agent, the pre-twisted preform produced in this way can be converted in a subsequent heat-shaping step into the desired twisted carbon band, wherein simultaneously a carbonization can take place in which the binding agent is transformed into carbon. With the use of a binding agent made of thermoplastic material, the final shaping of the preform can take place before or during the carbonization.

In an alternative and equally suitable procedure, it is provided that for shaping of the band-shaped preform, carbon fibers and a duroplastic material as the binding agent are used and that the preform is constructed as a twisted band. The final shape is stabilized by the carbonization.

In this procedure, the fiber-processing device directly generates a preform in the form of a twisted band. The preform here already essentially has the shape and dimensions of the final carbon band. The duroplastic binding agent is not soft in the subsequent carbonization step and therefore reduces the risk of deformation of the already twisted band. Thus, the duroplastic binding agent contributes to the thermal and mechanical stabilization of the preform during the carbonization step.

Furthermore, it has proven effective if the further processing to form the carbon band comprises a processing step of the carbonization of the band-shaped preform, wherein the binding agent is converted into carbon, wherein the ratio of the weight percentage of fiber to binding agent in the preform is set to a value in the range from 1:1 to 2.5:1.

The greater the fiber percentage within the preform is, the higher the strength of the resulting carbon band is. On the other hand, a certain percentage of binding agent is advantageous, in order to simplify the processing capacity of the carbon band according to the method according to the invention. Weight percentages of binding agent to fibers in the above-cited ratio range represent an especially suitable compromise.

Furthermore, it has proven effective if the further processing into the carbon band comprises a processing step of the electric contacting, in which the ends of the band-shaped preform are each provided with reinforcement through adhesion or lamination and subsequent carbonization.

The electrical contacting, that is the attachment of terminal elements for the electrical connection of the carbon band, can take place by mechanical joining processes. Preferably, the terminal elements are attached at a reinforcement of the ends of the carbon band generated by adhesion or lamination and subsequent carbonization by a form-fit or force-fit connection. An extensive mechanical post-processing of the carbon band for fixing the electrical connection is not absolutely required in this case, in order to achieve a dependable and operationally reliable type of contact.

The carbon band produced and prepared in this way is inserted in an envelope tube of an infrared heater.

With respect to the method for the production of the carbon infrared heater, the object specified above is achieved according to the invention starting from a method of the type cited above, in that the carbon band is produced, in which carbon fibers are fed to a fiber-processing device and shaped into a band-shaped preform having a centerline and an edge on both sides of this centerline, wherein, for the formation of the region close to the centerline, a fiber length smaller on average than the length for the formation of regions close to the edge is fed by the fiber-processing device, and the preform is then processed further to form the carbon band.

According to the invention, a twisted carbon band is generated from a preform that comprises essentially fibers, optionally with a binding agent, and that either already has the twisted structure or is set in the band at least so that a subsequent twisting can be achieved without greater mechanical loading.

For the production of this pre-twisted preform, a fiber-processing device is used to which carbon fibers are fed. When using a binding agent this surrounds the carbon fibers or bundles of carbon fibers completely or partially. By means of the fiber-processing device, an uneven, non-flat band is produced in the form of the pre-twisted preform. This takes place such that, for the production of the band in the region of the side edges, longer carbon fibers are supplied than for the production of the central region around the centerline of the band. In this way, the band-like preform obtains, in advance, a twisted structure or—for elongation of the band—a structure that buckles into folds at the two edges. Thus, it is essential that the fiber length on average is greater in the edge regions than in the center region.

For the resulting preform, a subsequent, mechanical twisting is either no longer needed or it is already set by the spatial distribution of the carbon fibers in the preform, so that it can be performed without greater mechanical loading of the preform.

The method according to the invention allows a uniform mass distribution of carbon fibers across the width of the twisted band. This property gives for a heating element produced from such a preform for a carbon infrared heater a remarkably good spatial homogeneity of the emission, and it effects an extension of the service life of the heating element.

The further processing of the preform comprises, as a rule, a carbonization step and—if still necessary—a processing step before the carbonization for the production of the final twisting from the pre-twisted preform, as well as a processing step in which the two ends of the carbonized preform are each provided with a metallic terminal for the power supply. Then, the carbon band produced in this way is installed in the quartz glass envelope tube.

With respect to preferred embodiments of the method according to the invention for the production of the carbon infrared heater, reference is made to the dependent claims for the method for the production of the carbon band and the associated explanations.

With respect to the carbon infrared heater, the object stated above is achieved according to the invention, starting from a carbon infrared heater having the features of the type cited above, in that the carbon band is produced according to the method according to the invention.

The carbon band of the carbon infrared heater according to the invention is produced with reference to the method explained above. This involves a stable band that is twisted about its longitudinal axis and whose ends are each connected to an electrical terminal element.

The electrical contacting of the carbon band to the electric, metallic terminal element is carried out typically by a form-fit or force-fit connection to a reinforcement of the ends of the carbon band generated previously by adhesion or lamination. In this way, a dependable and operationally reliable fixing of the electrical terminal elements is produced.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 1 a schematic sectional view of a carbon band twisted about its longitudinal axis having a terminal element clamped on this band, according to an embodiment of the invention.

DETAILED DESCRIPTION OF THE INVENTION

FIG. 1 shows schematically an embodiment of a carbon infrared heater according to the invention having an envelope tube 1 made of quartz glass having an outer diameter of 19 mm and a maximum heatable length of 2500 mm. The carbon infrared heater has an output of 40 W/cm at a filament temperature of 1200° C. The filament is constructed in the form of a carbon band 3 twisted about the longitudinal axis 2, which has a thickness of 0.15 mm and a width of 15 mm. The centerline 7 of the carbon band 3 coincides with the emitter longitudinal axis 2.

The ends of the carbon band 3 are reinforced by adhesion of a carbon block and connected to an electrical terminal element 4, wherein a rivet connection 5, which connects the carbon band 3 and terminal element 4 in a form-fit and force-fit, is provided by a drilled hole through the terminal element 4 and the carbon band 3 (not visible in FIG. 1).

In FIG. 1 a region 6 of the carbon band 3 close to the centerline and also regions 8 close to the edge are drawn schematically. In addition, for explaining the above equation (1) a distance "b" is drawn from the centerline 7 of the carbon band 3 to the region 6 close to the edge.

Below, the production of the carbon band 3 will be explained in detail with reference to an example.

Overall, 15 so-called rovings are prepared, each comprising straight, non-twisted bundles of ca. 2000 carbon fibers. The carbon-fiber bundles are encased with phenolic resin, a duroplastic material, and simultaneously fed to a textile processing device, like those otherwise used for the production of band-shaped, unidirectional tapes.

With the textile-processing device, a so-called tape is produced from the 15 rovings, in which the carbon fibers are present in unidirectional alignment. The ratio of the weight percentages of carbon fibers and binding agent equals approximately 1.7:1. One special feature of the method according to the invention consists in that the fiber bundles are not introduced uniformly into the tape, but instead in a length that increases from the centerline of the tape toward the lateral edges. Consequently, a greater fiber length is built in at the two lateral edge regions of the tape than in the center.

The fiber length fed locally to the tape is here determined with reference to the equation (1) specified farther above, wherein the fiber length from the centerline of the tape to the edge increases successively to 110% of the length of the tape centerline. In this way, a matrix-impregnated, unidirectional tape is obtained having a length of 1 m and a width of 10 mm (b=5 mm), which has a twist from the beginning on with 14.5 full 360° windings in the embodiment.

The tape produced in this way is then heated to a temperature of approximately 1000° C. in a protective gas, whereby the duroplastic binding agent is converted into a carbon matrix with the formation of gases containing hydrogen, carbon, and oxygen, so that a twisted carbon band is obtained, which consists essentially of carbon fibers having a unidirectional orientation in the twisted band plane, which are stabilized mechanically with the carbon matrix in their shape, as is shown schematically in FIG. 1.

The ends of the carbon band are connected (before or after the carbonization) to the electrical terminal elements 4. Then the band is installed in the envelope tube 1.

In the following Table 1, typical, especially preferred ranges for the fiber-length difference a−l [in meters] between the fiber length "a" in distance "b" from the centerline and the minimal fiber length l in the centerline (at l=1 meter) are specified as a function of the number of twists "u" and the width of the carbon band (here "b" corresponds to the half width of the carbon band).

TABLE 1

| | b = 7.5 mm | b = 5 mm | b = 2.5 mm |
|---|---|---|---|
| u = 10/m | 105 mm | 48.2 mm | — |
| u = 25/m | — | — | 74.3 mm |

In an alternative procedure for the production of the preform, fibers made of carbon and fibers made of polyetheretherketone (PEEK) having a volume ratio of 2 to 1 in the form of rovings, each having 1000 fiber bundles, are braided into a tape having a width of 15 mm (b=7.5 mm) and an average thickness of 0.2 mm. In addition, five supporting threads (warp or chaining) are worked in at the centerline, as well as at a distance of 3.5 and 7 mm to the left and right of the centerline. The supporting threads are fed according to their position and the goal of achieving 10 full windings to one meter having 1000 mm/1 m band on the centerline, or having 1024 mm/1 m band at a distance b=±3.5 mm and 1092 mm/1 m band at distance±7 mm from the centerline.

Then, the band is cut to length, provided with electrical contacts, and set in a mold, which mechanically stabilizes the band in the thermoplastic region of the PEEK. The band in its present, wound form is carbonized at 900° C. After cooling, the band can be removed from the mold and installed directly in an emitter.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A method for producing a carbon band twisted about a longitudinal axis for a carbon infrared heater, the method comprising feeding carbon fibers to a fiber-processing device, shaping the carbon fibers into a band-shaped preform having a centerline and an edge on both sides thereof;

wherein for shaping of a region close to the centerline, the fiber-processing device is fed carbon fibers having a first average fiber length and wherein for shaping of regions close to the edges, the fiber-processing device is fed carbon fibers having a second average fiber length;

wherein the first average fiber length is shorter than the second average fiber length; and then further processing the preform to form the carbon band.

2. The method according to claim 1, wherein an average fiber length of the carbon fibers fed to the fiber-processing device increases gradually from the first average fiber length utilized for the shaping of the region close to the centerline to the second average fiber length utilized for the shaping of the regions close to the edges.

3. The method according to claim 1, wherein an average fiber length "a" fed to the fiber-processing device is set as a function of a distance "b" from the centerline and a number of twists "u" along a length "l" of the centerline according to the following formula: $a=\sqrt{l^2+(2\cdot\pi\cdot b\cdot u)^2}$.

4. The method according to claim 1, wherein the first average fiber length fed to the fiber-processing device for the shaping of the region close to the centerline and the second average fiber length fed to the fiber-processing device for the shaping of the regions close to the edges differ between 4% and a maximum of 15% based on the the first average fiber length.

5. The method according to claim 1, wherein the band-shaped preform is generated as a textile fiber composite.

6. The method according to claim 5, wherein the textile fiber composite is selected from woven, braided, knitted, and knotted, wherein the fiber-processing device is a weaving, braiding, knitting, or knotting device.

7. The method according to claim 6, wherein a braided, knitted, or knotted fiber composite is stabilized by warp or chaining threads, and wherein a length of the warp or chaining threads varies as a function of their distance from the centerline.

8. The method according to claim 1, wherein the carbon fibers are fed to the fiber-processing device in the form of rovings in a straight orientation, each roving containing fewer than 6000 fibers.

9. The method according to claim 8, wherein each roving contains fewer than 1000 fibers.

10. The method according to claim 1, wherein, when forming the band-shaped preform, carbon fibers and a thermoplastic material as a binding agent are used, and wherein the preform is formed as a twisted band or as a non-twisted, curled band having folds alternating along a longitudinal axis above and below the centerline, wherein the further processing comprises a twisting of the preform.

11. The method according to claim 10, wherein a duroplastic material is used as the binding agent for the preform, and wherein the preform is formed as a twisted band.

12. The method according to one of claim 10, wherein the further processing to the carbon band comprises a processing step of carbonization of the band-shaped preform, wherein the binding agent is converted into a carbon, and wherein a ratio of percentages by weight of carbon fibers to binding agent in the preform is set at a value in a range of 1:1 to 2.5:1.

13. The method according to claim 1, wherein the further processing to the preform comprises a processing step of electrical contacting, in which ends of the band-shaped preform are each provided with a reinforcement by adhesion or lamination and subsequent carbonization.

14. A method for producing a carbon infrared heater utilizing a fiber-processing device, the method comprising preparing an envelope tube made of quartz glass, inserting into the envelope tube a carbon band twisted about its longitudinal axis, providing ends of the carbon band with electrical terminals, the electrical terminal extending out from the envelope tube, wherein the carbon band is produced from a preform manufactured by a method comprising:

feeding carbon fibers to the fiber-processing device;

wherein for shaping of a region close to a centerline of the preform, the fiber-processing device is fed carbon fibers having a first average fiber length and wherein for shaping of regions close to the edges of the preform, the fiber-processing device is fed carbon fibers having an second average fiber length;

wherein the first average fiber length is shorter than the second average fiber length; and then further processing the preform to form the carbon band.

15. A method for producing a carbon infrared heater using a carbon band produced by a method comprising:

feeding carbon fibers to a fiber-processing device, shaping the carbon fibers into a band-shaped preform having a centerline and an edge on both sides thereof;

wherein for shaping of a region close to a centerline of the preform, the fiber-processing device is fed carbon fibers having a first average fiber length and wherein for shaping of regions close to the edges of the preform, the fiber-processing device is fed carbon fibers having an second average fiber length;

wherein the first average fiber length is shorter than the second average fiber length; and then further processing the preform to form the carbon band.

16. A carbon infrared heater comprising an envelope tube made of quartz glass, a carbon band containing carbon fibers arranged in the envelope, the carbon band being twisted about its longitudinal axis and having ends provided with electrical terminals, the electrical terminals extending out from the envelope tube, wherein the carbon band comprises a centerline located along the longitudinal axis and edges that are distal from the centerline;

wherein the carbon fibers located in a region proximal to the centerline of the carbon band are of a first average length;

wherein the carbon fibers located in regions proximal to the edges of the carbon band are of a second average length; and wherein the first average length is shorter than the second average length.

* * * * *